US006705272B2

(12) United States Patent
Leipelt et al.

(10) Patent No.: US 6,705,272 B2
(45) Date of Patent: Mar. 16, 2004

(54) AIR INTAKE SYSTEM WITH AN AIR FILTER

(75) Inventors: Rudolf Leipelt, Hessigheim (DE); Rolf Fuesser, Bad Herrenalb (DE); Robert Vaculik, Marbach (DE); Thomas Haubold, Marbach (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 99 days.

(21) Appl. No.: 10/128,513

(22) Filed: Apr. 24, 2002

(65) Prior Publication Data

US 2003/0034004 A1 Feb. 20, 2003

Related U.S. Application Data

(63) Continuation of application No. PCT/EP00/09718, filed on Oct. 5, 2000.

(30) Foreign Application Priority Data

Oct. 26, 1999 (DE) ..... 199 51 408

(51) Int. Cl.[7] ..... F02B 77/00; F02M 35/10

(52) U.S. Cl. ..... 123/198 E; 123/184.55; 181/229

(58) Field of Search ..... 123/198 E, 556, 123/184.55, 184.56, 184.57; 181/229; 55/385.3

(56) References Cited

FOREIGN PATENT DOCUMENTS

| | | |
|---|---|---|
| DE | 4401585 | 7/1995 |
| DE | 19811051 | 9/1999 |
| EP | 0242797 | 10/1987 |
| JP | 6159072 | 6/1994 |
| JP | 10246161 | 9/1998 |

*Primary Examiner*—Noah P. Kamen
(74) *Attorney, Agent, or Firm*—Crowell & Moring LLP

(57) ABSTRACT

An air intake system for intake air of an internal combustion engine comprising a filter insert (19) in a housing (10) connected to the air conducting system by a plurality of inlets (13) and an outlet (22). The air inlets are provided with individual intake nozzles or fittings and lead to a single common air chamber (20) in the filter housing. The inlets (13) can be individually opened and closed by flap valves (24), thereby allowing the acoustics to be influenced favorably and enabling, for example, the respective intake fittings to be connected or disconnected depending on the temperature. The intake system requires only a limited number of components, and the design of the preferably wedge-shaped air chamber minimizes flow losses in the housing, which in turn decreases the intake noise. Shunt resonators (28) can also be formed using cover elements (29) and (30).

13 Claims, 1 Drawing Sheet

AIR INTAKE SYSTEM WITH AN AIR FILTER

CROSS REFERENCE TO RELATED APPLICATIONS

This application is a continuation of international patent application no. PCT/EP00/09718, filed Oct. 5, 2000, designating the United States of America, the entire disclosure of which is incorporated herein by reference. Priority is claimed based on Federal Republic of Germany patent application no. DE 199 51 408.9, filed Oct. 26, 1999.

BACKGROUND OF THE INVENTION

The invention relates to an intake system, in particular for the intake air of an internal combustion engine, having a filter cartridge and a plurality of intake fittings, at least one of which may be closed by a flap.

Intake systems of this type are known from the prior art. For example, published Japanese patent application no. JP 6-159072 describes an air filter system for an internal combustion engine which has a plurality of intake fittings 22, 24, 26 (see FIG. 1 of the cited document). The intake fittings open respectively into additional duct sections 44, 46, 48, in which air filter elements 50 are respectively fitted. The individual air filters and their appurtenant intake fittings may be connected or disconnected by opening or closing flaps 62, 64, 66, 68, 70, 72, depending on the operating state of the internal combustion engine. In particular, the intake noise of the associated internal combustion engine may thus be reduced. The volumetric requirements of the intake system, such as shunt resonators, for example, which otherwise would be a factor may be dispensed with, resulting in a smaller installation space requirement for the intake system.

However, the proposed solution also has disadvantages. The numerous individually switched flaps and the use of a plurality of air filters means a large number of individual components, so that the proposed solution presents a problem for economical production. In addition, the various air filter elements are impinged upon differently by air to be filtered, depending on the switching of the flaps. Thus, each filter element has a different service life, requiring the filters to be replaced at different times. The costs of operating the intake system are also increased, which is disadvantageous for the operator.

SUMMARY OF THE INVENTION

The object of the invention is to provide an improved air intake system for an internal combustion engine.

Another object of the invention is to provide an air intake system with a filter that has a low flow resistance in small installation spaces.

A further object of the invention is to provide an intake system with a filter in which the filter is uniformly impinged upon by air to be filtered.

It is also an object of the invention to provide an intake system which can be constructed with a low number of individual components.

Yet another object of the invention is to provide an intake system which achieves favorable acoustic properties.

These and other objects are attained in accordance with the present invention by providing an air intake system comprising a housing having a plurality of inlets and an outlet, a filter cartridge arranged in the housing between the inlets and the outlet such that a fluid drawn in through the inlets flows through the filter cartridge to the outlet, a plurality of intake fittings each attached to a respective inlet and having an intake opening upstream the attached inlet, and at least one flap valve situated between the intake opening of an intake fitting and the attached inlet for selectively opening and closing the intake fitting, in which the plurality of inlets all open into a common air chamber in the housing upstream of the filter cartridge.

The intake system according to the invention has a plurality of intake fittings which open into inlets in the filter housing. The intake fittings may be closed at least partially by flaps, thereby influencing the acoustics of the intake system depending on the operating conditions. The inlets all open into the same air chamber, which directly adjoins the filter cartridge of the intake system. A single filter cartridge may be mounted in the housing. However, it is also possible to operate a plurality of filter cartridges in parallel. The filter cartridges have smaller dimensions in proportion to the required filter surface, so that their stability with regard to pressure losses at the filter cartridge as well as pressure pulse oscillation may be improved.

The number of components required is advantageously reduced by use of the common air chamber. In addition, flow losses are decreased since economy in the number of partitions may be realized in the region of the common air chamber. Regardless of the position of the flap, and thus the number of closed intake fittings, the fluid to be filtered may be freely dispersed in the air chamber in order to subsequently penetrate the filter cartridge. This allows a more uniform impingement on the filter cartridge, with the loading of deposited particles being statistically distributed over the entire surface of the filter cartridge. The service life of the filter cartridge is thereby increased, since the pressure drop across the filter element which occurs as the result of the threshold loading is delayed. Because of the reduced number of components and the increased service life of the filter, the proposed solution is particularly economical in production as well as during operation.

In accordance with one specific embodiment of the invention, the air chamber has a wedge-shaped design. The filter cartridge, which in this case is flat, forms one side of the air chamber. The air chamber thus tapers corresponding to the reduction in the volumetric air flow which moves across the filter cartridge. This geometry is particularly advantageous for the flow. Hence, the fluid can flow through the intake system substantially free from separation, thereby minimizing the flow losses and intake noise which arise. In addition, such a geometry offers a particular economy of space due to the fact that the minimum required cross-sectional area is available on all sides of the air chamber, so that there is no unused volume.

A further improvement of the flow characteristics in the intake system may be realized when all the inlets are accommodated in the same housing wall section of the air chamber. The inlets are then aligned essentially parallel, thereby achieving unidirectional fluid flow in the air chamber. To absolutely minimize sudden changes in the cross-sectional area of the inlets to the air chamber, according to a specific embodiment of the invention, the housing wall section has a rectangular configuration, with the inlets occupying almost the entire surface of this wall section. It is advantageous if the inlets also have a rectangular configuration and are adjacently arranged. The housing wall section is thus entirely broken up by the inlets, up to the end faces of the walls of the intake fittings which form the inlets. The filter cartridge is then situated at least substantially opposite the inlets, thereby enabling the fluid to flow unhindered through the filter cartridge. This arrangement may be achieved in particular by use of the aforementioned wedge-shaped air chamber. In a wedge-shaped air chamber, the filter is disposed obliquely with respect to the inlets.

According to a further embodiment of the invention, the intake fittings may be connectors which allow the filter housing to be connected to continuing duct structures, with the duct structures forming the intake openings for the air which is drawn in. These connectors preferably have a circular design. With this design, commercially available tubes may be affixed to the system as additional duct structures without any difficulty. A large design space is thereby created which permits the described components to be used in different applications. Using identical parts for different applications results in savings particularly in machining costs, thus making the individual solutions more economical.

It is advantageous if sensors for controlling the flaps are provided as part of the intake system. These sensors can detect operating conditions in the intake system, from which the optimal flap position may be determined for the prevailing operating conditions. When the intake system is used for an internal combustion engine, the data for controlling the flap position(s) are basically dictated by engine parameters. These engine parameters such as rotational engine speed, for example, are determined external to the intake system.

However, the flaps may be used for other secondary functions of the intake system. For example, intake systems generally have a warm air duct which draws in warmed air at low ambient temperatures. To this end, branches are typically provided in the intake system, and are usually actuated by mechanical thermostatic switches. This additional expense may be eliminated if the duct system according to the invention, which is basically provided to create acoustic effects, also performs this function.

For this purpose, the individual intake openings of the different intake fittings are extended into various regions of the engine compartment. For example, an intake opening may be provided in the vicinity of the exhaust manifold, from which warmed air may be drawn in. The problem of undesired intake of rainwater or snow can be prevented by providing intake openings in substantially dry regions of the engine compartment, with these intake openings being used when the filter cartridge becomes too wet or freezes up.

As a prerequisite for the functioning of the intake system according to the invention, the entirety of the intake fittings must furnish at least the cross-sectional area necessary for the maximum air requirements of the internal combustion engine. For operating conditions in which the entire intake cross section is not needed, the inlets can be gradually closed, thereby significantly reducing the intake noise. If desired, the intake fitting which must always remain open can be designed without any flap.

Alternatively, to perform the secondary functions previously described, it may be practical to provide all intake fittings with flaps, thereby creating a larger bandwidth of possible switchings. This bandwidth may be enlarged if the total cross-sectional area provided by the intake fittings is larger than that needed for the required maximum quantity of fluid. In this way, a choice of different intake fittings may still be possible, even in operating conditions of the intake system in which the required maximum quantity of fluid is demanded.

However, the intake opening may also be accommodated in different regions of the engine compartment with acoustical considerations in mind. The intake noise may be modified as a function of the flap switching. Thus, the intake noise on the one hand may be reduced, and on the other hand may be increased under operating conditions in which the driver cannot receive feedback based on engine noise.

To economically produce the drive for the flaps, according to a particular embodiment of the invention the properties of a permanent magnet may be imparted to the flaps, with an electrical coil being situated in the zone of influence of this magnetic field. Switching the flap causes a current pulse to enter the coil. Complicated drives such as electric motors or vacuum cells may thus be dispensed with. The potential savings realized from this solution are significant when a plurality of flaps is used. If desired, the intake system may use switch flaps as described, for example, in published German patent application no. DE 44 01 585.

The described advantages of a wedge-shaped air chamber may naturally be transferred to the discharge chamber as well. The latter is connected downstream of the filter cartridge in the intake system, and communicates with an outlet for the filtered fluid.

Further advantages with respect to intake acoustics may be realized by providing the intake system with corresponding cavities by generally known means. These cavities may be designed, for example, as shunt resonators. At certain frequencies or broadbands such resonators result in attenuation of intake noise. By combining all acoustic measures, more acoustically effective intake systems may be designed, even with limited installation space.

The modularity of the system facilitates the creation of modular systems. These modular systems may comprise identical parts which can be combined with one another, depending on the application at hand. This design also allows acoustic measures to be taken after an internal combustion engine has been constructed. Such measures could be required when unexpected interfering noise appears in certain frequency ranges. Modules may be produced using different intake fittings, the switch flaps, the filter cartridges, and different housing covers which form acoustic cavities of various dimensions.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
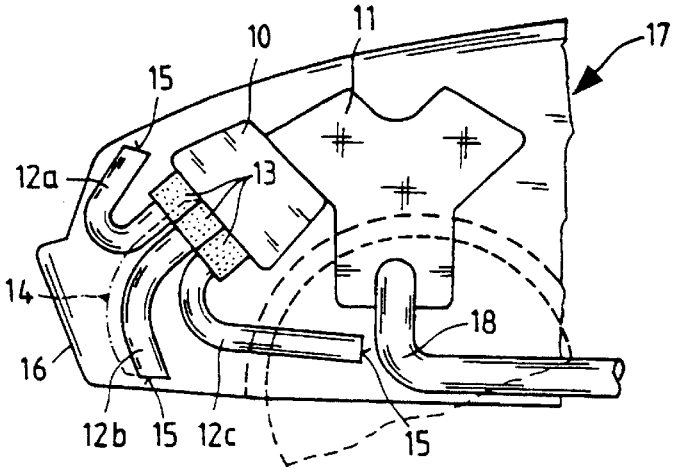
FIG. 1 is a schematic depiction of an intake system according to the invention in the engine compartment of an internal combustion engine.

FIG. 1 schematically represents an application for an intake system. The intake system comprises a housing 10 which is mounted on an engine block 11 of an internal combustion engine. Tubes 12*a*, 12*b* and 12*c* lead to inlets 13 on the housing, thus forming intake fittings 14 whose intake openings 15 are distributed within the engine compartment. Different effects may be thus achieved for the intake air. Tube 12*a* opens into a splash-proof region in the upper part of the engine compartment so that dry intake air can be drawn in through the tube, even under wet weather conditions. Tube 12*b* extends into the lower region of a fender 16 of a motor vehicle 17. The coolest intake air may be drawn in from that point. However, under extremely cold weather conditions it is necessary to mix in warm air. Such warmed air may be drawn in via tube 12*c*, which opens in the vicinity of an exhaust manifold 18 of engine block 11.

Figure 2:
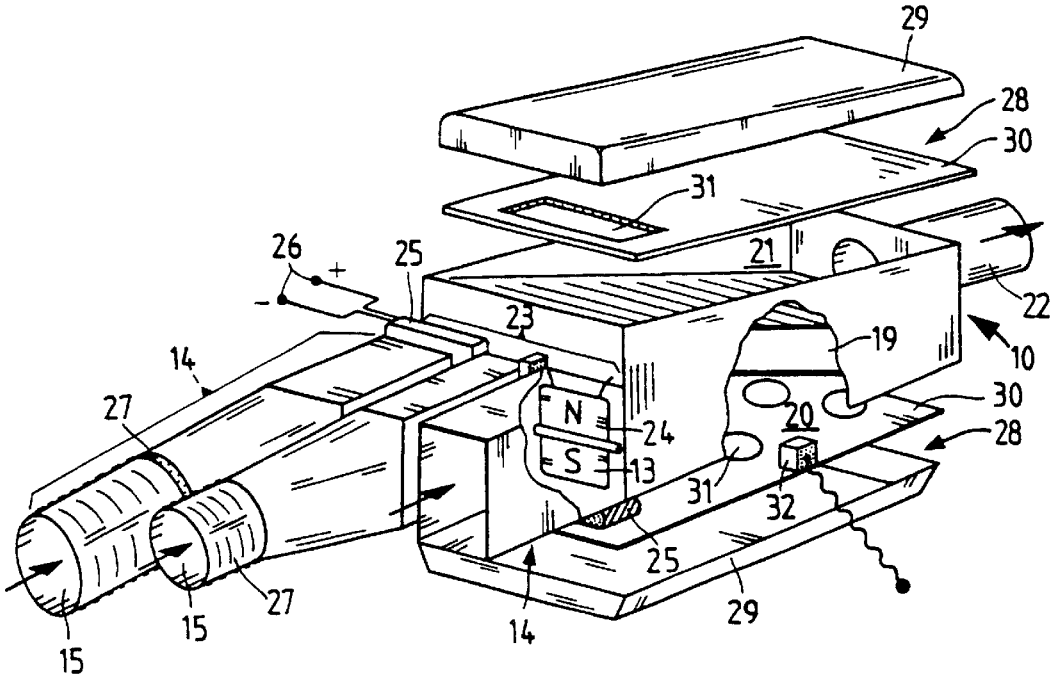
FIG. 2 is a perspective view of an intake system according to the invention with an air filter housing.

FIG. 2 schematically illustrates a possible design of the intake system. Housing 10 has a modular design. The housing has a basic shape of a rectangular solid, with a filter cartridge 19 installed along a diagonal of the interior of the housing body. The filter cartridge divides the interior into an air chamber 20 and a discharge chamber 21. The combustion air flows through three inlets 13, one of which is visible in cutaway intake fitting 14, into air chamber 20 which tapers in a wedge-shaped fashion from the inlets to the opposite side of housing 10, corresponding to the reduction in the volumetric air flow. The volumetric flow decreases from that point on, due to the fact that intake air flows through filter cartridge 19 and in a similar manner reaches discharge chamber 21, which likewise has a wedge-shaped design. At this point the air mass flow increases in the direction of an outlet 22 and exits housing 10 through the outlet 22.

All inlets 13 are arranged in a housing wall section 23 which at the same time forms the end face of wedge-shaped air chamber 20. The intake air is thus able to flow from intake fittings 14 directly to air chamber 20 without a bypass. Both external intake fittings are provided with flaps 24 by which the intake fittings can be opened or closed. The flap drive comprises coils 25 which enclose intake fittings 14 provided with a flap and which are connected to power supply 26. Appropriate electrical current pulses to coils 25 cause flaps 24, which form a permanent magnet (indicated by north pole N and south pole S), to assume the closed or open position.

In the illustrated embodiment, the center intake fitting has no flap. When the two other intake fittings are closed by flaps, the flow of intake air is conducted through the center intake fitting. From this intake fitting, the aspirated air can disperse in air chamber 20 without significant flow losses.

The intake fittings comprise a fixed part, integrated into housing 10, defining a connector 27. As shown on the center intake fitting, this connector may be used itself as an intake opening 15. Another option is to dispose a tube 12*a* on the connector, thus lengthening the intake fitting. Intake opening 15 is then formed by the end of the tube. Alternatively, of course, other duct structures made of plastic may be fitted onto the connector. In this manner the system acquires a modular design which can be adapted to engine compartments having different dimensions.

However, the modular design of housing 10 also allows other acoustic devices such as shunt resonators 28 to be fitted to the air intake system. These devices comprise covers 29 which with the insertion of a partition 30 form the base surfaces of housing 10. The partitions have openings 31 of different geometric shapes for influencing the acoustic behavior of the shunt resonators. The volume of the resonator and consequently its acoustic behavior can also be influenced by providing various covers which in particular take installation space for the housing into account.

A water sensor 32 is also installed in air chamber 20. A signal from this water sensor can be used to close inlets 13 under wet weather conditions, when there is a particularly high risk of drawing in water.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An air intake system comprising:

a housing having a plurality of inlets and an outlet;

a filter cartridge arranged in said housing between the inlets and the outlet such that a fluid drawn in through the inlets flows through the filter cartridge to the outlet;

a plurality of intake fittings each attached to a respective inlet and having an intake opening upstream the attached inlet, at least one flap valve situated between the intake opening of an intake fitting and the attached inlet for selectively opening and closing said intake fitting; and structures defining cavities communicating with said housing for attenuating intake noise;

wherein said plurality of inlets all open into a common air chamber in said housing upstream of the filter cartridge.

2. An intake system according to claim 1, wherein said air chamber has a wedge-shaped configuration, and said filter cartridge has a flat configuration and forms one side of said air chamber.

3. An intake system according to claim 1, wherein said plurality of inlets are all accommodated in a housing wall section situated opposite the filter cartridge.

4. An intake system according to claim 3, wherein said housing wall section has a rectangular configuration, and said plurality of inlets occupy substantially the entire surface of the rectangular housing wall section.

5. An air intake system according to claim 1, wherein said intake fittings are each connected to a respective intake duct.

6. An air intake system according to claim 5, wherein said intake ducts are air pipes which extend to different areas of an engine compartment of a motor vehicle.

7. An air intake system according to claim 1, further comprising at least one sensor for controlling said at least one flap valve.

8. An air intake system according to claim 1, wherein said at least one flap valve comprises a permanent magnet disposed within a zone of influence of an electrical coil, whereby said flap valve can be opened or closed in response to an electric current flowing through said coil.

9. An air intake system according to claim 1, wherein said housing comprises a discharge chamber having a wedge-shaped configuration arranged downstream of the filter cartridge.

10. An air intake system according to claim 1, wherein said cavities comprise shunt resonators.

11. An air intake system according to claim 1, wherein said intake system is connected to an internal combustion engine of a motor vehicle.

12. An air intake system according to claim 1, wherein each one of said plurality of intake fittings is provided with a respective flap valve for selectively opening or closing the intake fitting.

13. An air intake system according to claim 1, wherein all but one of said intake fittings is provided with a respective flap for opening or closing.

* * * * *